US012121770B2

(12) United States Patent
Miller

(10) Patent No.: US 12,121,770 B2
(45) Date of Patent: Oct. 22, 2024

(54) HAND MANIPULATING DEVICE AND METHODS OF MAKING AND USING SAME

(71) Applicant: Brandon Miller, Easton, PA (US)

(72) Inventor: Brandon Miller, Easton, PA (US)

( * ) Notice: Subject to any disclaimer, the term of this patent is extended or adjusted under 35 U.S.C. 154(b) by 268 days.

(21) Appl. No.: 17/959,430

(22) Filed: Oct. 4, 2022

(65) Prior Publication Data

US 2023/0147554 A1 May 11, 2023

Related U.S. Application Data

(60) Provisional application No. 63/277,258, filed on Nov. 9, 2021.

(51) Int. Cl.

| | |
|---|---|
| ***A63B 23/16*** | (2006.01) |
| ***A63B 21/00*** | (2006.01) |
| ***A63B 21/04*** | (2006.01) |
| ***A63B 21/055*** | (2006.01) |

(52) U.S. Cl.

CPC ..... *A63B 23/16* (2013.01); *A63B 21/0428* (2013.01); *A63B 21/0552* (2013.01); *A63B 21/4045* (2015.10)

(58) Field of Classification Search

CPC ..... A63B 21/0428; A63B 21/0552; A63B 21/4035; A63B 21/4045; A63B 22/00; A63B 23/16; A63B 2022/0092; A63B 2022/0094

See application file for complete search history.

(56) References Cited

U.S. PATENT DOCUMENTS

| | | | | |
|---|---|---|---|---|
| 4,350,335 | A * | 9/1982 | Pasbrig | A63B 23/16 482/47 |
| 4,484,744 | A * | 11/1984 | Gmunder | A63F 9/0857 273/153 S |
| 5,147,256 | A * | 9/1992 | Silagy | A63B 23/16 482/49 |
| 5,395,279 | A * | 3/1995 | McCann | A63H 33/00 446/490 |
| 5,431,611 | A * | 7/1995 | Silagy | A63B 23/16 482/122 |
| 5,775,693 | A * | 7/1998 | Clancy | A63F 9/0857 273/153 S |
| 6,746,373 | B1 * | 6/2004 | Bohmer | A63B 21/05 482/44 |
| 9,005,084 | B2 * | 4/2015 | Silagy | G06F 1/1626 482/44 |
| 9,114,280 | B2 * | 8/2015 | Silagy | A63B 23/16 |
| 9,421,419 | B1 * | 8/2016 | Goldberg | A63B 21/0428 |
| 9,616,286 | B1 * | 4/2017 | Zamarripa | A63B 23/16 |
| 10,905,967 | B1 * | 2/2021 | Satok-Wolman | A44C 13/00 |
| 10,926,165 | B2 * | 2/2021 | Shimel | A63F 3/00634 |

(Continued)

*Primary Examiner* — Joshua Lee

(74) *Attorney, Agent, or Firm* — James R. McDaniel

(57) ABSTRACT

A hand manipulation device and methods of making and using which include a plurality of rails and connectors that are interconnected to allow the user to push and/or pull on the device so that the connectors slide along the rails. In this manner, the hand manipulating device provides an ability for the user to perform various therapeutic exercises with his/her hands and fingers. Additionally, the hand manipulation device can be equipped with elastomeric bands that can be used to provide an additional elastic force in order to further exercise the user's hands and fingers.

8 Claims, 6 Drawing Sheets

(56) References Cited

U.S. PATENT DOCUMENTS

| | | | | |
|---|---|---|---|---|
| 11,433,268 | B2 * | 9/2022 | Kupferman | A63B 21/0455 |
| 11,504,579 | B2 * | 11/2022 | D'Addario | A63B 21/023 |
| 2003/0131710 | A1 * | 7/2003 | Goldiner | G09B 15/06 84/265 |
| 2011/0272882 | A1 * | 11/2011 | Yahyavi | A63F 9/0861 273/153 S |
| 2013/0095901 | A1 * | 4/2013 | Houlis | G09B 23/00 463/9 |
| 2020/0094103 | A1 * | 3/2020 | Wallander | A63B 23/12 |

* cited by examiner

B
A
4c
6c
12c
18c
20c
16c
14c
18d
12d
6d
4d
22c
22d
14b
20b
20d
16d
14d
4b
6b
12b
22b
16b
18b
22a
14a
20a
16a
4a
18a
12a
6a
B
A

HAND MANIPULATING DEVICE AND METHODS OF MAKING AND USING SAME

CROSS-REFERENCE TO RELATED APPLICATION

This application is a continuation-in-part of U.S. Patent Application 63/277,258, filed on Nov. 9, 2021, the disclosure of which is hereby incorporated by reference in its entirety to provide continuity of disclosure to the extent such a disclosure is not inconsistent with the disclosure herein.

FIELD OF THE INVENTION

The present invention is generally related to a hand manipulating device that includes a plurality of rails and a plurality of connectors that are interconnected to allow the user to push and/or pull on the device so that the connectors slide along the rails. In this manner, the hand manipulating device provides an ability for the user to perform various therapeutic exercises with his/her hands and fingers.

BACKGROUND OF THE INVENTION

Prior to the present invention, as set forth in general terms above and more specifically below, it is known, to use a variety of hand manipulating devices for performing various therapeutic exercises. For example, spring-based manipulating devices have been used to strengthen the user's hands and wrists. Also, a variety of hand manipulating devices have been used to train the user's fingers to pick up objects. Providing a self-contained, hand manipulating device that provides therapeutic exercises for the user's fingers and hands would prove to be a significant advancement over current practices.

It is a purpose of this invention to fulfill these and other needs in the hand manipulating device art in a manner more apparent to the skilled artisan once given the following disclosure.

The preferred hand manipulating device, according to various embodiments of the present invention, offers the following advantages: ease of use; portability; self-containment; the ability to provide therapeutic exercises for the user's hands and fingers; the ability to easily change the resistance of the hand manipulating device; durability; ease of cleaning; ease of parts replacement; the ability to be made into a variety of colors; and reduced cost. In fact, in many of the preferred embodiments, these advantages are optimized to an extent that is considerably higher than heretofore achieved in prior, known the hand manipulating devices.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

In order to address the shortcomings of the prior, known hand manipulating devices, it would be desirable to provide a self-contained, hand manipulating device that provides therapeutic exercises for the user's fingers and hands which would prove to be a significant advancement over the current hand manipulating devices.

Figure 1A:
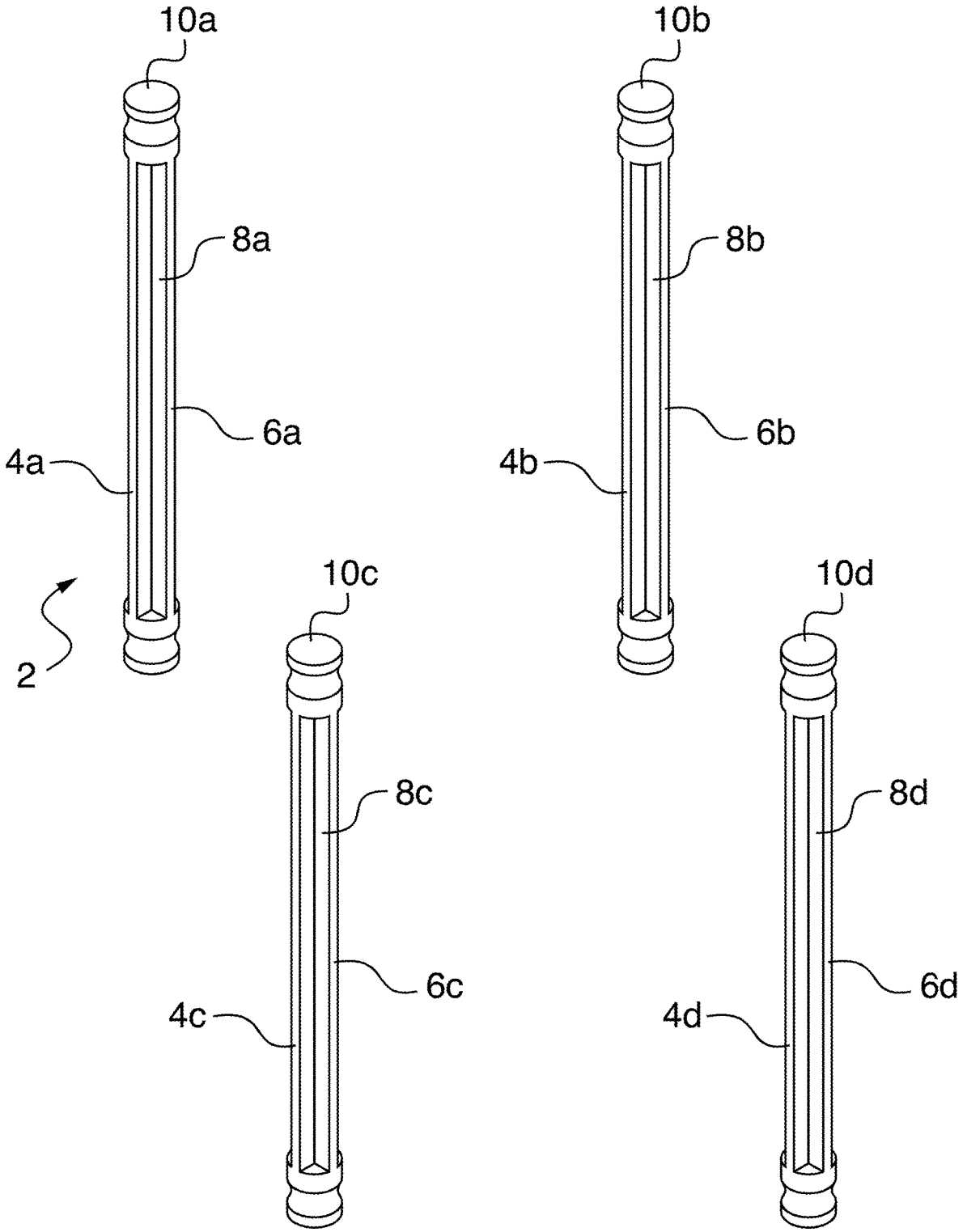
FIGS. 1A and 1B are schematic, top views of the components of a hand manipulating device, prior to being constructed, according the present invention.
Figure 1B:
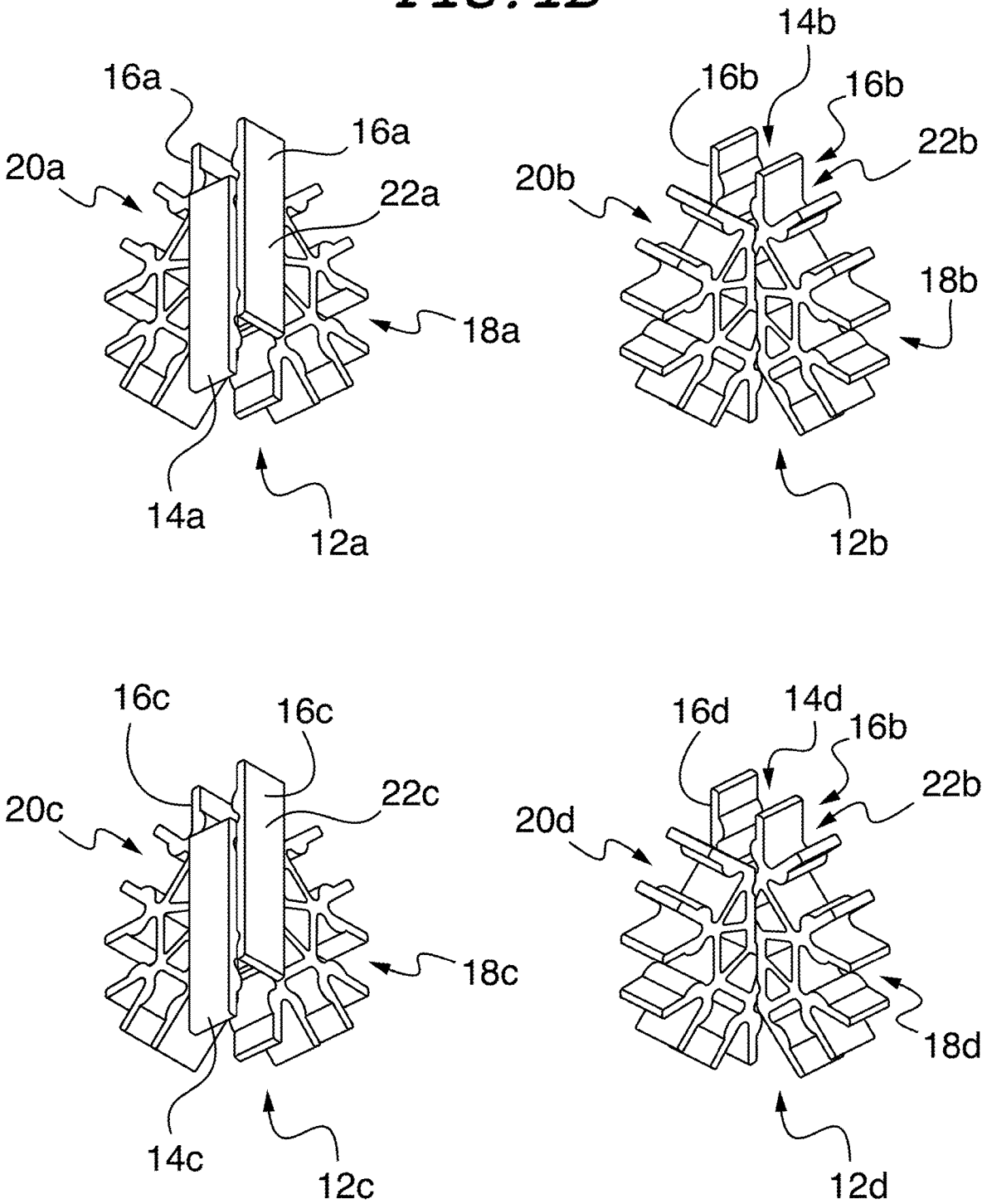

Reference is made now to FIGS. 1A and 1B, where there are illustrated the components for the construction of the hand manipulating device 2. In particular, hand manipulating device 2 includes, in part, rails 4*a*-4*d* (FIG. 1A) and connectors 12*a*-12*d* (FIG. 1B). Preferably, the rails 4*a*-4*d* and the connectors 12*a*-12*d* are constructed of any suitable, durable, flexible, easily cleanable, rust-resistant, polymeric material.

Hand Manipulating Device Components

Figure 2:
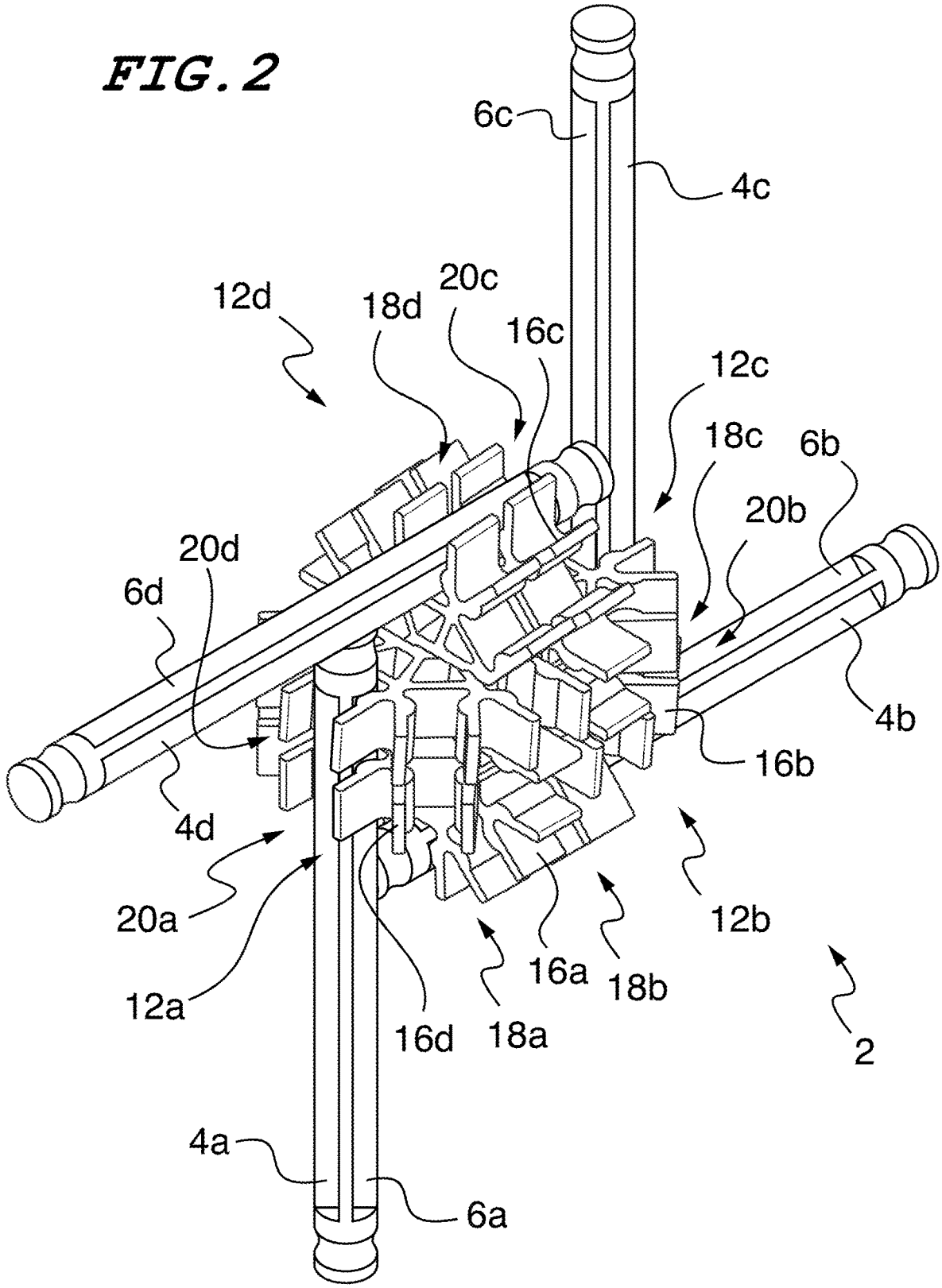
FIG. 2 is a schematic, top view of the hand manipulating device, constructed according the present invention.
Figure 3:
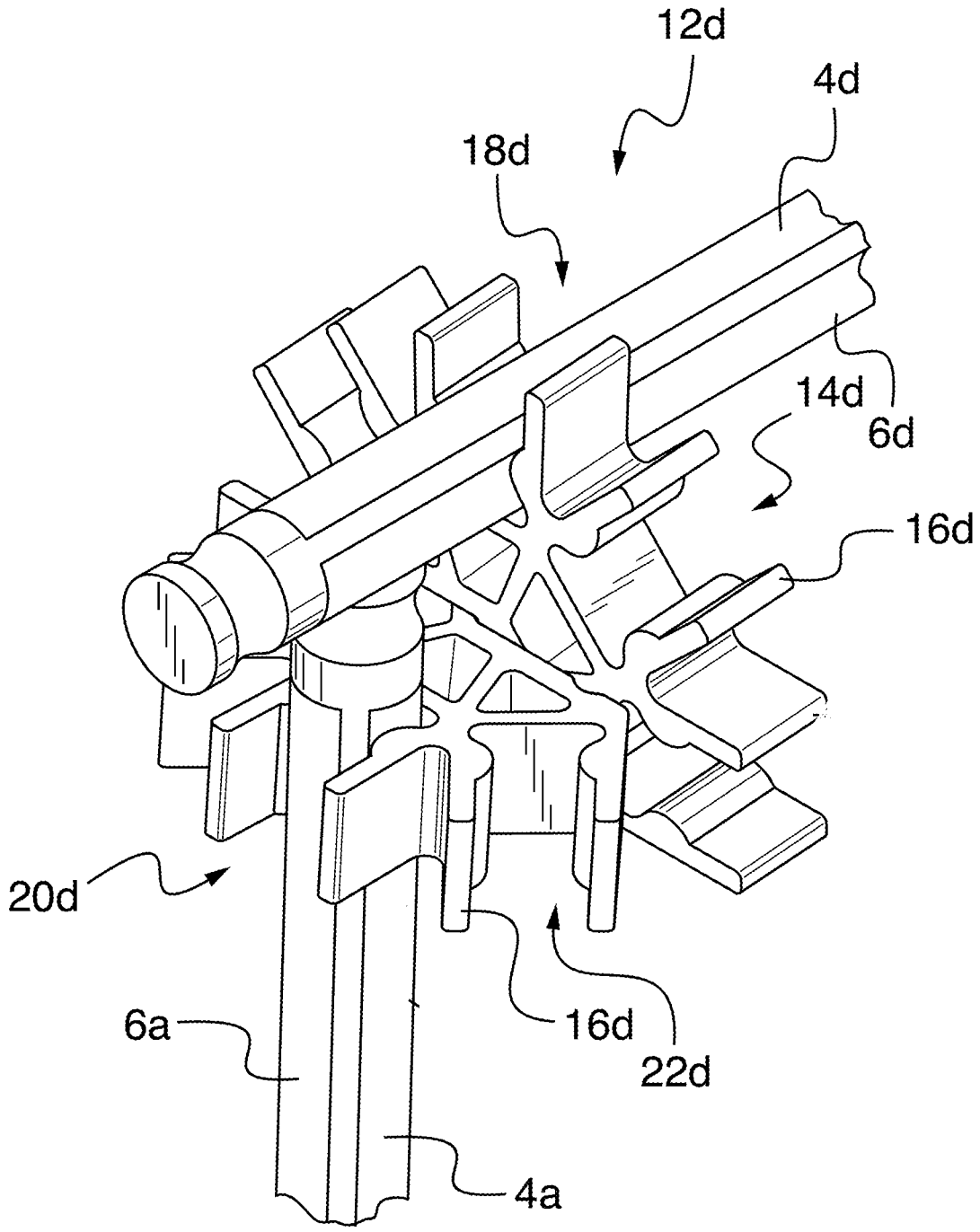
FIG. 3 is a schematic, close-up, top view of the hand manipulating device, constructed according the present invention.

As shown in FIGS. 1A, 1B, 2, and 3, hand manipulating device 2 includes rails 4*a*-4*d* and the connectors 12*a*-12*d*. Furthermore, each of the rails 4*a*-4*d* includes, in part, grooves 6*a*-6*d*, rail extensions 8*a*-8*d*, and rail ends 10*a*-10*d*, respectively. Preferably, rails 4*a*-4*d* can range in length from 3-6 inches and in diameter from ¼ to ½ inches. Also, rails 4*a*-4*d* can constructed in a variety of colors. As will be discussed in greater detail later, connectors 12*a* and 12*d* interact with and slide along grooves 6*a* and rail extension 8*a*, connectors 12*a* and 12*b* interact with and slide along grooves 6*b* and rail extension 8*b*, connectors 12*b* and 12*c* interact with and slide along grooves 6*c* and rail extension 8*c*, and connectors 12*c* and 12*d* interact with and slide along grooves 6*d* and rail extension 8*d* (FIGS. 2 and 3). It is to be understood that connectors 12*a*-12*d* should be constructed so as to be able to slide relatively easily along the length of rails 4*a*-4*d*, respectively. It is to be further understood that rails 4*a*-4*d* should be constructed with rail ends 10*a*-10*d* so that connectors 12*a*-12 do not slide off of rails 4*a*-4*d*, respectively. Finally, it is to be understood that grooves 6*a*-6*d* and rail extensions 8*a*-8*d* should extend almost entirely along the entire length of the rails 4*a*-4*d*, respectively.

With respect to connectors 12*a*-12*d*, as shown in FIG. 1B, connector 12*a* includes, in part, resistance retaining area 14*a*, connector extensions 16*a*, rail connector 18*a*, rail connector 20*a*, and resistance retaining area 22*a*. Preferably, connectors 12*a*-12*d* can range in thickness from % to ½ inches and in diameter from 1 to 1½ inches. Also, connectors 12*a*-12*d* can constructed in a variety of colors. Connector 12*b* includes, in part, resistance retaining area 14*b*, connector extensions 16*b*, rail connector 18*b*, rail connector 20*b*, and resistance retaining area 22*b*. Connector 12*c* includes, in part, resistance retaining area 14*c*, connector extensions 16*c*, rail connector 18*c*, rail connector 20*c*, and resistance retaining area 22*c*. Connector 12*d* includes, in part, resistance retaining area 14*d*, connector extensions 16*d*, rail connector 18*d*, rail connector 20*d*, and resistance retaining area 22*d*. It is to be understood that connector extensions 16*a*-16*d* can vary in length depending upon the user. For example, if the user is elderly and is having issues with the user's fingers being able to grab objects, connector extensions 16*a*-16*d* can be made longer so that the elderly user will be able more easily use the hand manipulating device 2.

A unique aspect of the present invention is the use of elastomeric bands 50*a* and 50*b*. It is to be understood that elastomeric bands 50*a* and 50*b* (FIG. 5) can be attached onto connector extensions 16*a*-16*d* in order to increase the amount of effort that will be required to pull the connectors 12*a*-12*d* apart from each other (along the directions of arrows A-A) or push the connectors 12*a*-12*d* towards each other (along the directions of arrows B-B), as will be discussed in greater detail later.

Hand Manipulating Device Assembly

With respect to the assembly of hand manipulating device 2, attention is directed to FIGS. 1A, 1B, 2, 3, and 4. In order to assemble hand manipulating device 2, rail 4*a* is attached to connector 12*a* at rail connector 20*a*. In particular, rail 4*a* is placed into rail connector 20*a* through a "snap-fit" connection between rail 4*a* and rail connector 20*a* so that connector 12*a* is attached to rail 4*a*, but connector 12*a* can also slide along rail 4*a*. Secondly, rail 4*b* is attached to connector 12*a* at rail connector 18*a*. In particular, rail 4*b* is placed into rail connector 18*a* through a "snap-fit" connection between rail 4*a* and rail connector 18*a* so that connector 12*a* is attached to rail 4*b*, but connector 12*a* can also slide along rail 4*b*. Thirdly, rail 4*b* is attached to connector 12*b* at rail connector 18*b*. In particular, rail 4*b* is placed into rail connector 18*b* through a "snap-fit" connection between rail 4*b* and rail connector 18*b* so that connector 12*b* is attached to rail 4*b*, but connector 12*b* can also slide along rail 4*b*. Fourthly, rail 4*c* is attached to connector 12*b* at rail connector 20*b*. In particular, rail 4*c* is placed into rail connector 20*b* through a "snap-fit" connection between rail 4*c* and rail connector 20*b* so that connector 12*b* is attached to rail 4*c*, but connector 12*b* can also slide along rail 4*c*. Fifthly, rail 4*c* is attached to connector 12*c* at rail connector 18*c*. In particular, rail 4*c* is placed into rail connector 18*c* through a "snap-fit" connection between rail 4*c* and rail connector 18*c* so that connector 12*c* is attached to rail 4*c*, but connector 12*c* can also slide along rail 4*c*. Sixthly, rail 4*d* is attached to connector 12*c* at rail connector 20*c*. In particular, rail 4*d* is placed into rail connector 20*c* through a "snap-fit" connection between rail 4*d* and rail connector 20*c* so that connector 12*c* is attached to rail 4*d*, but connector 12*c* can also slide along rail 4*d*. Seventhly, rail 4*d* is attached to connector 12*d* at rail connector 18*d*. In particular, rail 4*d* is placed into rail connector 18*d* through a "snap-fit" connection between rail 4*d* and rail connector 18*d* so that connector 12*d* is attached to rail 4*d*, but connector 12*d* can also slide along rail 4*d*. Finally, rail 4*a* is attached to connector 12*d* at rail connector 20*d*. In particular, rail 4*a* is placed into rail connector 20*d* through a "snap-fit" connection between rail 4*a* and rail connector 20*d* so that connector 12*d* is attached to rail 4*a*, but connector 12*d* can also slide along rail 4*a*.

Using Hand Manipulating Device

In order to use hand manipulating device 2, attention is directed to FIGS. 1A-5. In particular, the user can grasp ahold of or otherwise interact with two (2) of the connectors 12*a*-12*d*, preferably two (2) of the connectors 12*a*-12*d* that are located diagonally across from one another. For simplicity in explanation, assume that the user grasps connectors 12*a* and 12*c* at connector extensions 16*a* and 16*c*, respectively. Also, assume that the connectors 12*a*-12*d* are located in close proximity to each other as shown in FIG. 2.

The user can then begin to manipulate hand manipulating device 2 by pulling on connectors 12*a* and 12*c* in opposite directions so that connectors 12*a* and 12*c* are pulled away from each other. It is to be understood that in this manner, connectors 12*b* and 12*d* also are pulled away from each other.

Figure 4:
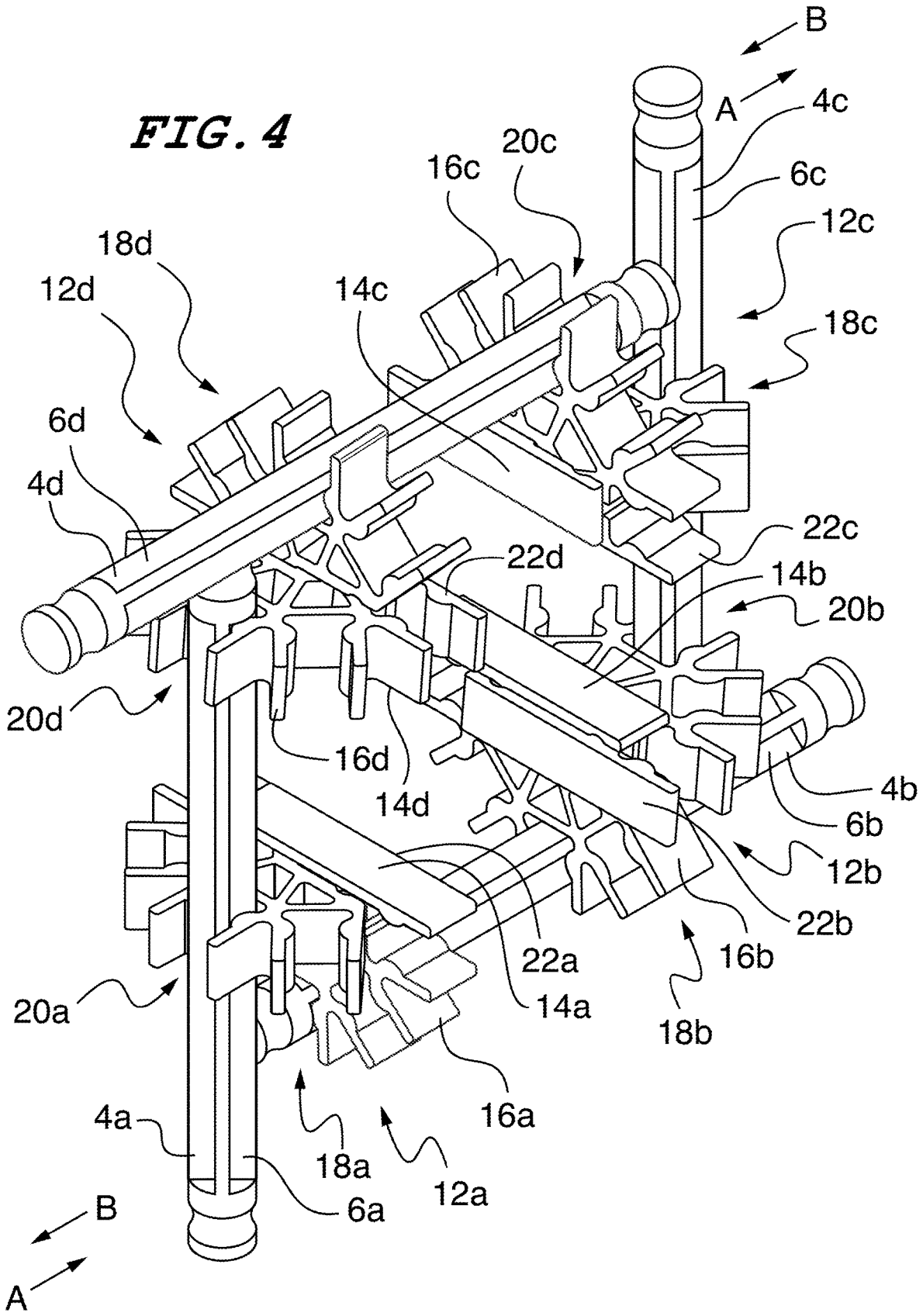
FIG. 4 is a schematic, top view of the hand manipulating device with the connectors being pulled away from each other, according the present invention.

As shown in FIG. 4, as the connectors 12*a* and 12*c* are pulled away from each other along the direction of arrows A-A, connector 12*a* slides along rail 4*a* and connector 12*c* slides along rail 4*c*. It is to be understood that as connectors 12*a* and 12*c* are pulled away from each other, connector 12*b* slides along rail 4*b* and connector 12*d* slides along rail 4*d*.

Figure 5:
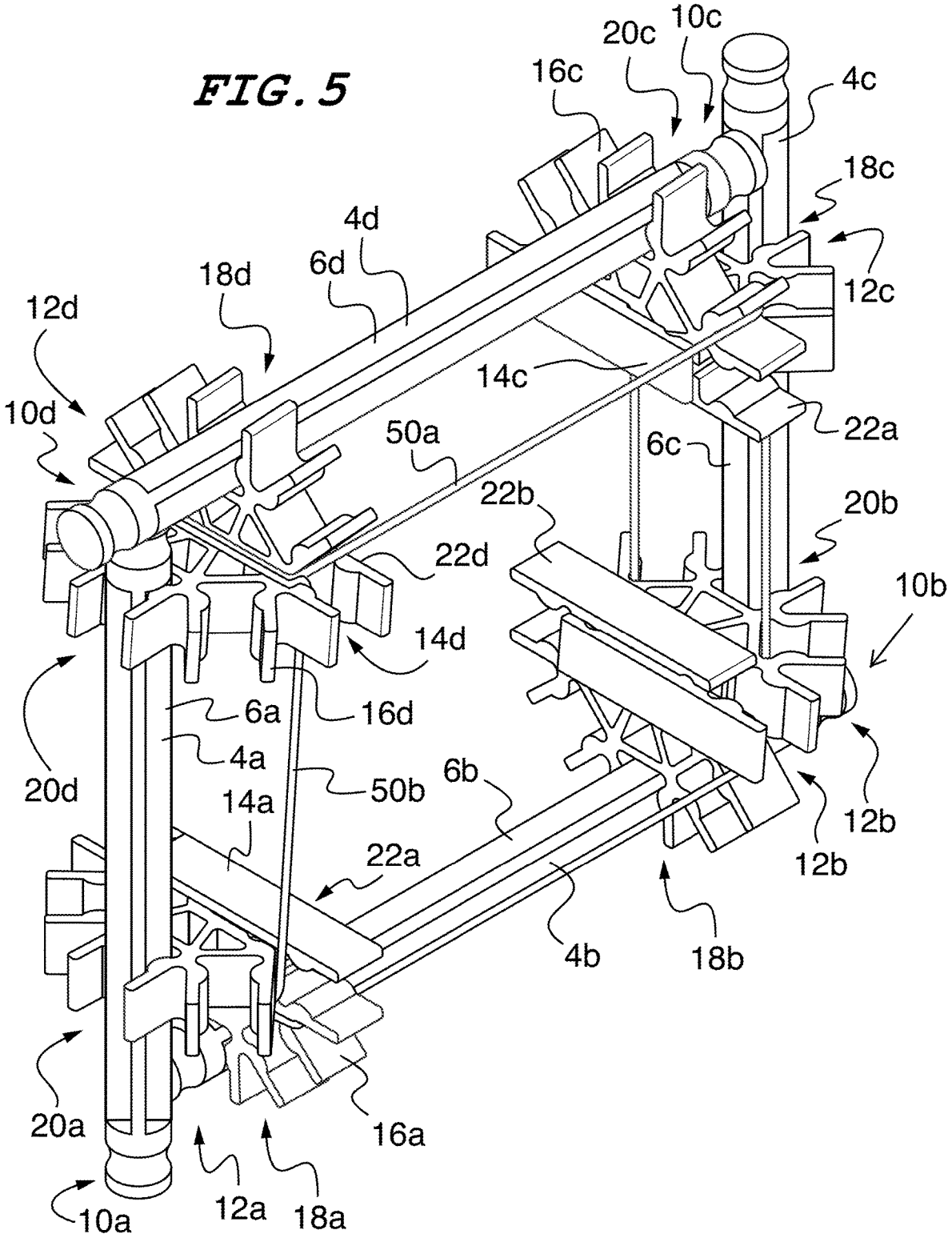
FIG. 5 is a schematic, top view of the hand manipulating device with the connectors being pulled even further away from each other and optional elastomeric bands being located on the hand manipulating device, according the present invention.

As shown in FIG. 5, connector 12*a* slides along rail 4*a* and connector 12*c* slides along rail 4*c* until connector 12*a* reaches rail end 10 band connector 12*c* reaches rail end 10*c*. It is to be understood that connector 12*b* slides along rail 4*b* and connector 12*d* slides along rail 4*d* until connector 12*b* reaches rail end 10 band connector 12*d* reaches rail end 10*d*.

A unique aspect of the present invention is that the user is able to push and pull opposing connectors (12*a* and 12*c*) or (12*b* and 12*d*) so that the connectors 12*a*-12*d* slide along rails 4*a*-4*d*.

Another unique aspect of the present invention is that the size (length and/or width) of connector extensions 16*a*-16*d* can be adjusted in order to accommodate a variety of users. For example, if the user is having difficulty grasping objects, the connector extensions 16*a*-16*d* can be made longer and/or wider to assist the user.

A further unique aspect of the present invention is the use of elastomeric bands 50*a* and 50*b*. In particular, as discussed above, elastomeric bands 50*a* and 50*b* (FIG. 5) or other similar devices can be placed on connectors 12*a*-12*d*. For example, if elastomeric bands 50*a* and 50*b* are placed around connector extensions 16*a*-16*d*, the elasticity of the elastomeric bands 50*a* and 50*b* could be adjusted to increase the amount to effort it will take for the user to pull apart connectors 12*a* and 12*c* (and connectors 12*b* and 12*d*) diagonally away from each other along the direction of arrows A-A or push the connectors 12*a*-12*d* towards each other along the direction of arrows B-B. In particular, the user will have to overcome the elasticity force of the elastomeric bands 50*a* and 50*b* on the connector extensions 16*a*-16*d* before the user will be able to slide the connectors 12*a* and 12*c* along rails 4*a* and rails 4*c* (and connectors 12*b* and 12*d* along rails 4*b* and rails 4*d*), respectively. In this manner, the user will be able to build up hand strength through the use of the elastomeric bands 50*a* and 50*b* around the connector extensions 16*a*-6*d*.

Another unique aspect of the present invention is that the rails 4*a*-4*d* and the connectors 12*a*-12*d* can be color coded in order to denote different sizes (lengths, widths, and/or diameters).

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

An of the features disclosed in this specification may be combined in any combination. Thus, unless expressly stated otherwise, each feature disclosed is only an example of a generic series of equivalent or similar features.

The specific methods and compositions described herein are representative of preferred embodiments and are exemplary and not intended as limitations on the scope of the invention. Other objects, aspects, and embodiments will occur to those skilled in the art upon consideration of this specification and are encompassed within the spirit of the invention. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other modifications and implementations will occur to those skilled in the art without departing from the spirit and the scope of the invention. Accordingly, the description hereinabove is not intended to limit the invention.

Therefore, provided herein is a new and improved hand manipulating device, which according to various embodiments of the present invention, offers the following advantages: ease of use; portability; self-containment; the ability to provide therapeutic exercises for the user's hands and fingers; the ability to easily change the resistance of the hand manipulating device; durability; ease of cleaning; ease of parts replacement; the ability to be made into a variety of colors; and reduced cost.

In fact, in many of the preferred embodiments, these advantages of ease of use, portability, self-containment, the ability to provide therapeutic exercises for the user's hands and fingers, the ability to easily change the resistance of the hand manipulating device durability, ease of cleaning, ease of parts replacement, the ability to be made into a variety of color, and reduced cost are optimized to an extent that is considerably higher than heretofore achieved in prior, known hand manipulating devices.

I claim:

1. A hand manipulating device, comprising:

a plurality of connectors, wherein each of the plurality of connectors comprises:

a first resistance retaining area, a connector extension operatively connected to the first resistance retaining area, a first rail connector operatively connected to the connector extension, a second resistance retaining area located adjacent to the first resistance retaining area, and a second rail connector operatively connected to the second resistance retaining area; and a plurality of rails, wherein each of the plurality of rail comprises:

a plurality of rail extensions each having a first end and a second end, a rail groove located adjacent to each of the plurality of rail extensions, and a plurality of rail ends located at each of the first and second ends of the plurality of rail extensions.

2. The hand manipulating device, according to claim 1, wherein the hand manipulating device is further comprised of:

at least one elastomeric band operatively connected to each of the plurality of connectors.

3. A method of constructing a hand manipulation device, comprising:

providing a plurality of connectors, wherein each of the plurality of connectors comprises:

a first resistance retaining area, a connector extension operatively connected to the first resistance retaining area, a first rail connector operatively connected to the connector extension, a second resistance retaining area located adjacent to the first resistance retaining area, and a second rail connector operatively connected to the second resistance retaining area; and providing a plurality of rails, wherein each of the plurality of rail comprises:

a plurality of rail extensions each having a first end and a second end, a rail groove located adjacent to each of the plurality of rail extensions, and a plurality of rail ends located at each of the first and second ends of the plurality of rail extensions.

4. The method, according to claim 3, wherein the method is further comprised of the step of:

providing at least one elastomeric band, wherein the at least one elastomeric band is operatively connected to each of the plurality of connectors.

5. The method, according to claim 3, wherein the method is further comprised of the steps of:

providing first, second, third, and fourth connectors from the plurality of connectors;

providing first, second, third, and fourth rails from the plurality of rails;

attaching the first rail to the first connector, wherein the first rail is capable of sliding on the first connector;

attaching the second rail to the first connector;

attaching the second rail to the second connector, wherein the second rail is capable of sliding on the second connector;

attaching the third rail to the second connector;

attaching the third rail to the third connector, wherein the third rail is capable of sliding on the third connector;

attaching the fourth rail to the third connector;

attaching the fourth rail to the fourth connector, wherein the fourth rail is capable of sliding on the fourth connector; and attaching the first rail to the fourth connector.

6. A method of using a hand manipulation device, comprising:

providing a plurality of connectors, wherein each of the plurality of connectors comprises:

a first resistance retaining area, a connector extension operatively connected to the first resistance retaining area, a first rail connector operatively connected to the connector extension, a second resistance retaining area located adjacent to the first resistance retaining area, and a second rail connector operatively connected to the second resistance retaining area;

providing a plurality of rails, wherein each of the plurality of rail comprises:

a plurality of rail extensions each having a first end and a second end, a rail groove located adjacent to each of the plurality of rail extensions, and a plurality of rail ends located at each of the first and second ends of the plurality of rail extensions;

locating at least two of the plurality of connectors, wherein the at least two of the plurality of connectors are not located adjacent to each other;

grasping the at least two of the plurality of connectors;

pulling the at least two of the plurality of connectors in a direction away from each other; and pushing the at least two of the plurality of connectors in a direction towards each other.

7. The method, according to claim 6, wherein the method is further comprised of the step of:

providing at least one elastomeric band, wherein the at least one elastomeric band is operatively connected to each of the plurality of connectors.

8. The method, according to claim 7, wherein the method is further comprised of the step of:

pulling the at least two of the plurality of connectors in a direction away from each other to cause the at least one elastomeric band to create an elastic force on the plurality of connectors.

* * * * *